US006823882B1

(12) United States Patent
Innes

(10) Patent No.: US 6,823,882 B1
(45) Date of Patent: Nov. 30, 2004

(54) TENT ASSEMBLY

(76) Inventor: James Michael Innes, 11502 W. Greengold Rd., Hanna City, IL (US) 61536

( * ) Notice: Subject to any disclaimer, the term of this patent is extended or adjusted under 35 U.S.C. 154(b) by 140 days.

(21) Appl. No.: 10/269,544

(22) Filed: Oct. 11, 2002

(51) Int. Cl.[7] ..... E04H 15/04
(52) U.S. Cl. ..... 135/125; 135/90; 135/117
(58) Field of Search ..... 135/90, 95, 96, 135/117, 120.1, 120.2, 120.3, 120.4, 900, 901; 5/121, 95, 96, 127, 128, 129, 130

(56) References Cited

U.S. PATENT DOCUMENTS

| | | | | | |
|---|---|---|---|---|---|
| 2,284,900 | A | * | 6/1942 | Henderson et al. | 5/122 |
| 2,792,844 | A | * | 5/1957 | Clark | 224/259 |
| 3,198,200 | A | | 8/1965 | Sanders | |
| 3,240,217 | A | | 3/1966 | Bird et al. | |
| 3,288,157 | A | * | 11/1966 | Szkolny | 135/95 |
| 3,464,430 | A | * | 9/1969 | McQuaid | 135/90 |
| 3,800,814 | A | | 4/1974 | Hibbert | |
| 3,929,145 | A | * | 12/1975 | Schroeder | 135/128 |
| 3,960,161 | A | * | 6/1976 | Norman | 135/126 |
| 3,970,096 | A | | 7/1976 | Nicolai | |
| 4,057,859 | A | * | 11/1977 | Setterholm | 5/121 |
| 4,071,917 | A | * | 2/1978 | Mojica | 5/121 |
| 4,320,542 | A | * | 3/1982 | Cohen | 5/121 |
| 4,607,655 | A | * | 8/1986 | Wagner et al. | 52/2.19 |
| D336,505 | S | | 6/1993 | Danaher | |
| 5,277,214 | A | * | 1/1994 | Tolley | 135/133 |
| 6,338,356 | B1 | * | 1/2002 | Wallenstatter | 135/100 |
| 6,347,638 | B1 | * | 2/2002 | Scott et al. | 135/95 |

FOREIGN PATENT DOCUMENTS

| | | | |
|---|---|---|---|
| FR | 2726599 | * | 5/1996 |
| WO | 97/07307 | * | 2/1997 |

* cited by examiner

*Primary Examiner*—Janet M. Wilkens

(57) ABSTRACT

A tent assembly for providing an easily pitched and ventilated tent structure. The tent assembly includes a main portion that can be held in an expanded position using lines and loops on an exterior of the main portion. The ends are closable and screen assemblies are provided adjacent each end of the main portion.

20 Claims, 4 Drawing Sheets

TENT ASSEMBLY

BACKGROUND OF THE INVENTION

1. Field of the Invention

The present invention relates to tents and more particularly pertains to a new tent assembly for providing an easily pitched and ventilated tent structure.

2. Description of the Prior Art

The use of tents is known in the prior art. U.S. Pat. No. 3,929,145 describes a tubular tent structure having spaced rigid hoops to give form to the tent. Another type of tent is U.S. Pat. No. 3,800,914 having a side opening and conventional support structure to give form to the tent. U.S. Pat. No. 3,240,217 provides a shelter having a hemispherical cross-section and spaced rigid supports. U.S. Pat. No. 3,198,200 and U.S. Pat. No. 3,970,096 both disclose flat-bottomed tents using rigid spaced supports. U.S. Des. Pat. No. 336,505 discloses an ornamental appearance for a flat-bottomed portable tent.

While these devices fulfill their respective, particular objectives and requirements, the need remains for a device that has certain improved features such as the non-rigid loops on the outer surface and lines to hold the tent in an expanded position to provide maximum ease in setting up the tent without need for rigid supports. Further, the above prior art does not provide the closable ends and screen structures of the present invention.

SUMMARY OF THE INVENTION

The present invention meets the needs presented above by providing a tubular main portion and loops securable to relatively stationary objects to permit holding the main portion in an expanded position sufficient for temporarily providing shelter.

Still yet another object of the present invention is to provide a new tent assembly that has ends that may be scaled off to provide privacy or screen light from entering an interior of the tent.

Even still another object of the present invention is to provide a new tent assembly that provides screens to permit ventilation through the tent.

To this end, the present invention generally comprises a main portion that can be held in an expanded position using lines and loops on an exterior of the main portion. The ends are closable and screen assemblies are provided adjacent each end of the main portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
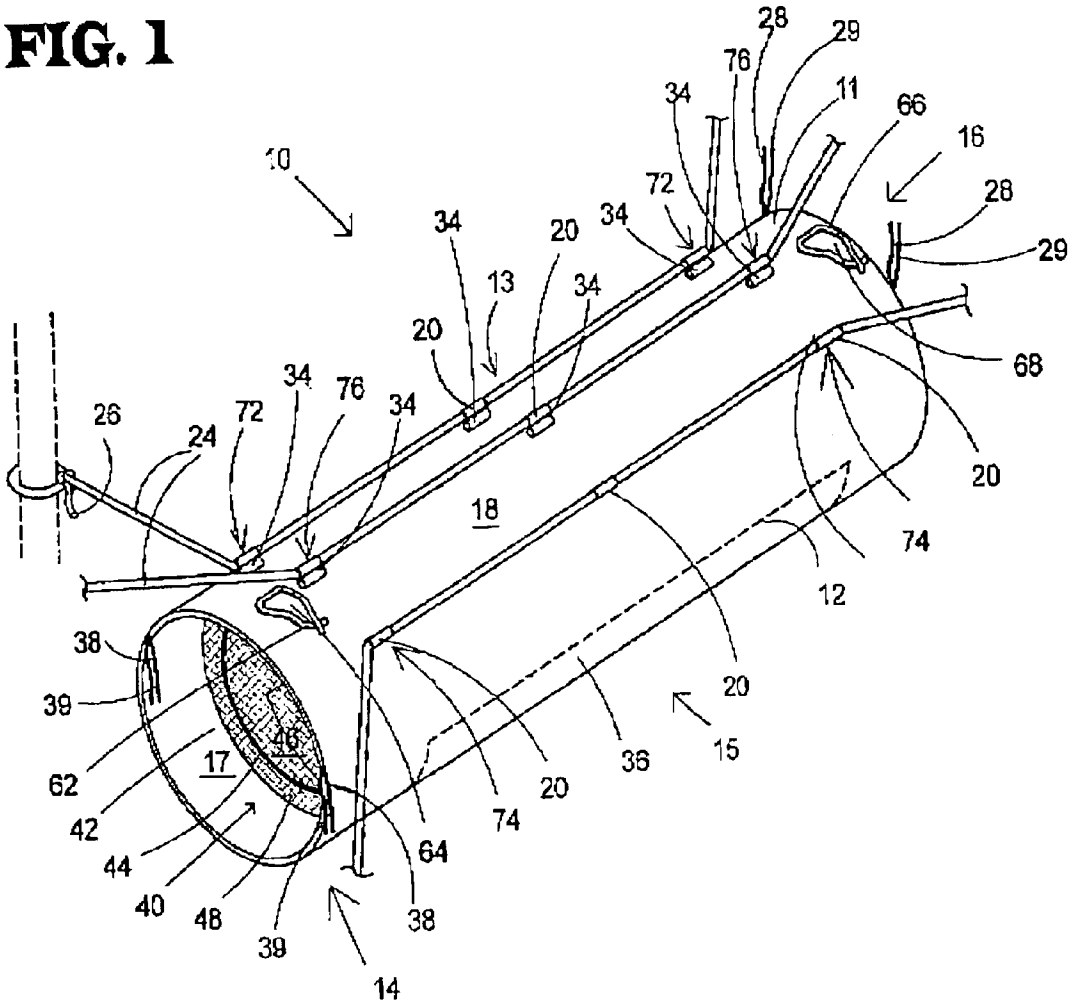
FIG. 1 is a perspective view of a new tent assembly according to the present invention.
Figure 2:
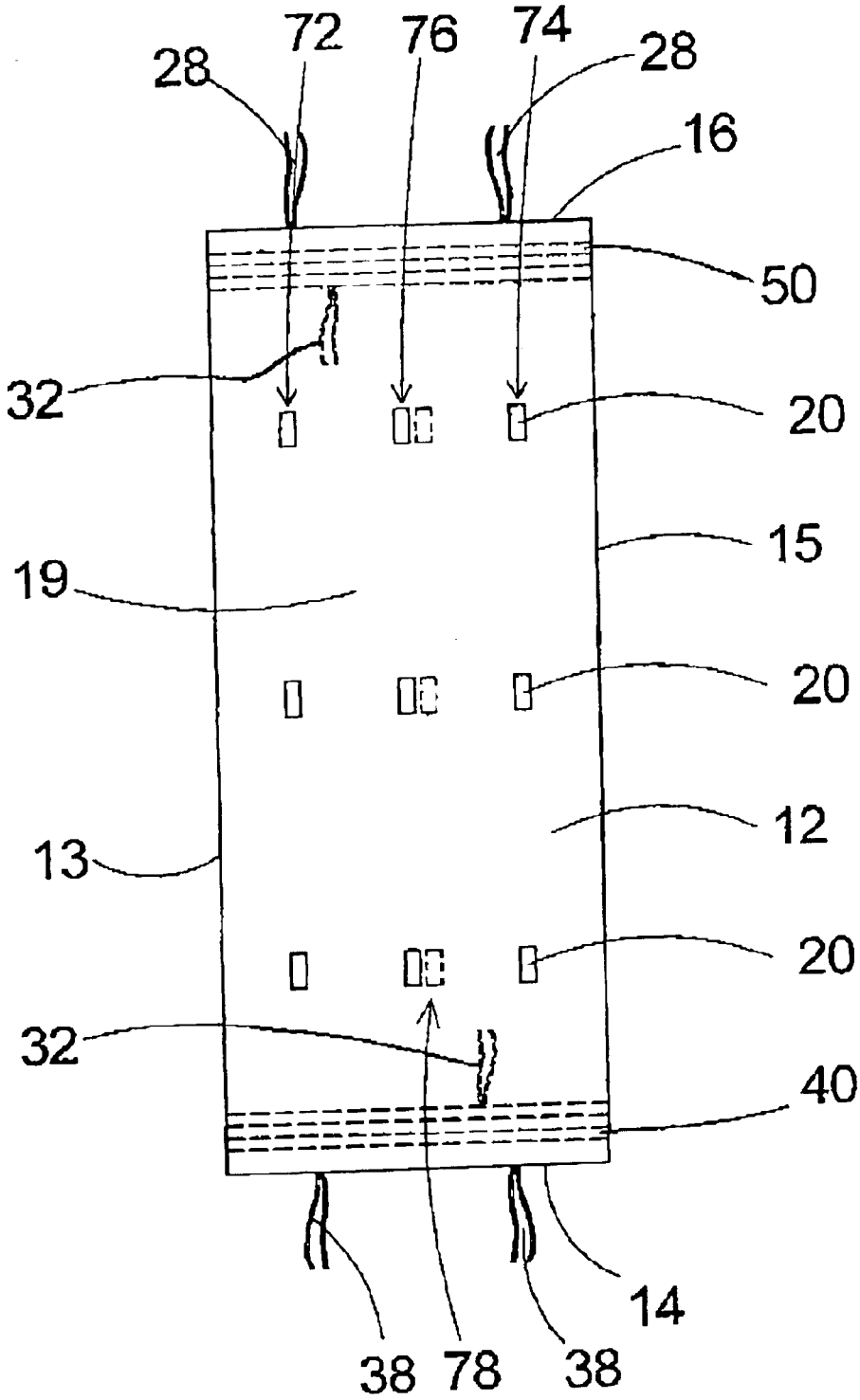
FIG. 2 is a top view of the present invention.
Figure 3:
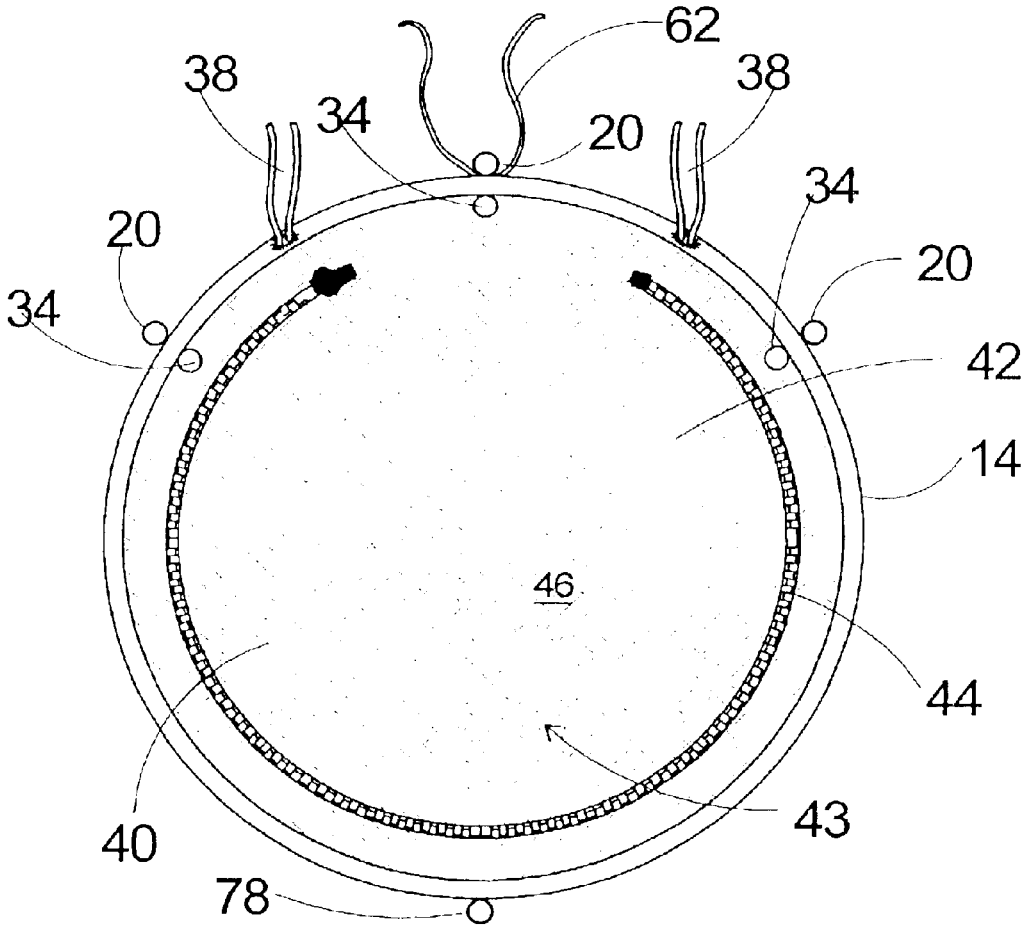
FIG. 3 is a first end view of the present invention.
Figure 4:
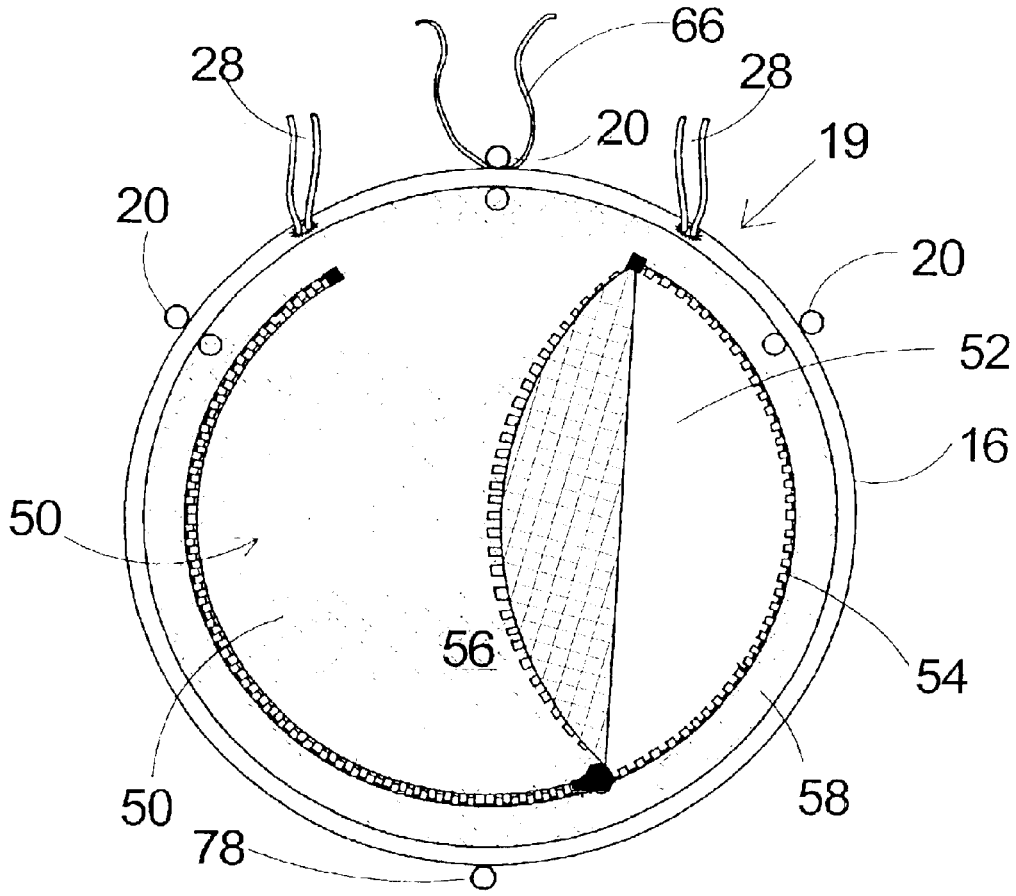
FIG. 4 is a second end view of the present invention.

With reference now to the drawings, and in particular to FIGS. 1 through 4 thereof, a new tent assembly embodying the principles and concepts of the present invention and generally designated by the reference numeral 10 will be described.

As best illustrated in FIGS. 1 through 4, the tent assembly 10 generally comprises a tubular main portion 12 that has a first open end 14 and a second open end 16. A plurality of exterior loop members 20 are coupled to an outer surface 18 of the main portion 12. A plurality of support line members 24 are provided. Each of the support line members 24 is coupled to at least one of the exterior loop members 20. Each of the support line members 24 has a free end 26. Thus, each of the support line members 24 is designed for coupling to an object such that the exterior loop members 20 are held in a substantially static position relative to each other for holding the main portion 12 in an expanded position to permit a person to enter the main portion 12.

A pair of drawstring line members 32 are provided. Each of the drawstring line members 32 is coupled to the main portion 12 proximate an associated one of the first and second open ends, 14 and 16, for selectively closing the first and second open ends, 14 and 16.

A first screen assembly 40 is coupled to an interior 17 of the main portion 12 proximate the first open end 14. The first screen assembly 40 has a screen opening 42 adjustable between an open position and a closed position for selectively screening the first open end 14. The screen assembly 40 is designed for permitting environmental communication through the first open end 14 when the first screen assembly 40 is in the closed position.

A second screen assembly 50 is coupled to the interior 17 of the main portion 12 proximate the second open end 16. The second screen assembly 50 has a screen opening 52 adjustable between an open position and a closed position for selectively screening the second open end 16. The second screen assembly 50 is designed for permitting environmental communication through the second open end 16 when the second screen assembly 50 is in the closed position.

In an embodiment, the first and second screen assemblies 40 and 50 are positioned between the respective drawstring line members 32 and the respective open ends 14 and 16 to permit use of the drawstring line members 32 by a person enclosed between the screen assemblies 40 and 50.

A first screen zipper 44 is coupled to the first screen assembly 50. The first screen zipper 44 extends around a central portion 46 of the first screen assembly 40 to form the screen opening 42. Thus, the central portion 46 of the first screen assembly 40 is selectively openable to permit movement through the first screen assembly 40.

In an embodiment, the first screen zipper 44 extends around a lower perimeter portion of the central portion 46 of the first screen assembly 40 to form a flap 43 that hangs down from an upper portion of the screen assembly 40.

A second screen zipper 54 is coupled to the second screen assembly 50. The second screen zipper 54 extends around a central portion 56 of the second screen assembly 50 to form the screen opening 52. Thus, the central portion 56 of the second screen assembly 50 is selectively openable to permit movement through the second screen assembly 50.

In an embodiment, the second screen zipper 54 extends around a lower perimeter portion of the central portion 56 of the second screen assembly 50 to form a flap 53 that hangs down from an upper portion of the screen assembly 50.

A first pair of tent support string members 62 extend from the outer surface 18 of the tubular main portion 12 proximate the first end 14. Each of the first tent support string members 62 is engageable to another of the first tent support string members 62 to form a first adjustment loop 64. A size of the first adjustment loop 64 is adjustable by tying the first tent support string members 62 together at a desired position along lengths of the first pair of tent support string members 62.

A second pair of tent support string members 66 extends from the outer surface 18 of the tubular main portion 12 proximate the second end 16. Each of the second pair of tent support string members 66 is engageable to another of the second pair of tent support string members 66 to form a second adjustment loop 68. A size of the second adjustment loop 68 is adjustable by tying the second pair of tent support string members 66 together at a desired position along lengths of the second pair of tent support string members 66.

In an embodiment, the plurality of loop members 20 includes a first, second and third set of loop members, 72, 74 and 76 respectively. The first set of loop members 72 is aligned along a first side 13 of the tubular main portion 12. The second set of loop members 74 is aligned along a second side 15 of the tubular main portion 12. The third set of loop members 76 is aligned along a top 11 of the tubular main portion 12.

In an embodiment, the plurality of loop members includes a bottom set of loop members 78. The bottom set of loop members 78 includes three loop members positioned opposite the third set of loop members 76 along a bottom of the tubular main portion 12 for anchoring the bottom of the main portion 12.

In an embodiment, each of the sets of loop members has three loop members each for a total of nine loop members 20.

In an embodiment, the tubular main portion 12 has a substantially circular shaped cross section taken transverse to a longitudinal axis extending through a center of the tubular main portion and the first and second sets of loop members 72 and 74 are coupled to an upper half 19 of the tubular main portion 12.

A plurality of interior loop members 34 are coupled to an upper portion of the interior surface 17 of the main portion 12. Thus, the interior loop members 24 are designed for hanging items from the upper portion of the interior surface 17. In an embodiment, each of the interior loop members 34 is aligned with an associated one of the exterior loop members 20 to provide direct support to the interior loop members 34.

The main portion 12 has a reinforced portion 36 positioned opposite from the exterior loop members 20 such that the reinforced portion 36 forms a floor of the tent assembly 10 when the support line members 24 engage the exterior loop members 20 to hold the main portion 12 in the expanded position.

Two pairs of first end outer tent support string members 38 extend from the outer surface 18 of the tubular main portion proximate the first end 14. Each pair of outer tent support string members 38 is positioned on a respective side of the main portion 12. Each of the outer tent support string members 38 is engageable to another of the outer tent support string members 38 to form a pair of first end outer adjustment loops 39. The size of each outer adjustment loop 39 is adjustable by tying the outer tent support string members 38 together at a desired position along lengths of each pair of outer tent support string members 38.

Two pairs of second end outer tent support string members 28 extend from the outer surface 18 of the tubular main portion 12 proximate the second end 16. Each of the second end outer tent support string members 28 is engageable to another of the second end outer tent support string members 28 to form a pair of second end adjustment loops 29. The size of each second adjustment loop 29 is adjustable by tying the second end outer tent support string members 28 together at a desired position along lengths of the second end outer tent support string members 28.

The length of all the various tent support string members may be relatively short to permit formation of loops to facilitate tying to a supporting structure using another line or rope or, alternately, relatively long to permit tying of the tent support string members directly to surrounding support structures.

In use, the support line members are secured to relatively stationary objects such as trees, rocks or a parked vehicle to hold the main portion in an expanded position. The first and second ends can be closed off using the drawstrings or screened off as desired. The tent assembly of the present invention thus provides easily pitched, ventilated, temporary shelter when desired.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative-only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A tent assembly comprising:

a tubular main portion having a first open end and a second open end;

a plurality of exterior loop members coupled to an outer surface of said main portion;

a plurality of support line members, each of said support line members being coupled to at least one of said loop members, each of said support line members having a free end whereby each of said support line members is adapted for coupling to an object such that said loop members are held in a substantially static position relative to each other for holding said main portion in an expanded position;

a pair of drawstring line members, each of said drawstring line members being coupled to said main portion proximate an associated one of said first and second open ends for selectively closing said first and second open ends; and a pair of tent support string members extending from said outer surface of said tubular main portion proximate said first end, each of said tent support string members being engageable to another of said tent support string members to form an adjustment loop, a size of said adjustment loop being adjustable by tying said tent support string members together at a desired position along lengths of said pair of tent support string members.

2. The tent assembly of claim 1, further comprising:

a screen assembly coupled to an interior of said main portion proximate said first open end, said screen assembly having a screen opening adjustable between an open position and a closed position for selectively screening said first open end, said screen assembly permitting environmental communication through said first open end when said screen assembly is in said closed position.

3. The tent assembly of claim 2, further comprising:

said screen assembly being a first screen assembly;

a second screen assembly coupled to said interior of said main portion proximate said second open end, said second screen assembly having a screen opening adjustable between an open position and a closed position for selectively screening said second open end, said second screen assembly permitting environmental communication through said second open end when said second screen assembly is in said closed position.

4. The tent assembly of claim 3 further comprising:

said second screen assembly being positioned between said second open end of said main portion and said drawstring assembly coupled proximate said second open end.

5. The tent assembly of claim 2, further comprising:

a screen zipper coupled to said screen assembly, said screen zipper extending around a central portion of said screen assembly whereby said central portion of said screen assembly is selectively openable to permit movement through said screen assembly.

6. The tent assembly of claim 5, further comprising:

said screen zipper extending around a lower perimeter portion of said central portion of said screen assembly to form a flap.

7. The tent assembly of claim 2 further comprising:

said screen assembly being positioned between said first open end of said main portion and said drawstring assembly coupled proximate said first open end.

8. The tent assembly of claim 1, further comprising:

said pair of tent support string members being a first pair of tent support string members and said adjustment loop being a first adjustment loop;

a second pair of tent support string members extending from said outer surface of said tubular main portion proximate said second end, each of said second pair of tent support string members being engageable to another of said second pair of tent support string members to form a second adjustment loop, a size of said second adjustment loop being adjustable by tying said second pair of tent support string members together at a desired position along lengths of said second pair of tent support string members.

9. The tent assembly of claim 1, further comprising:

said plurality of exterior loop members including a first, second and third set of exterior loop members;

said first set of exterior loop members being aligned along a first side of said tubular main portion;

said second set of exterior loop members being aligned along a second side of said tubular main portion; and said third set of exterior loop members being aligned along a top of said tubular main portion.

10. The tent assembly of claim 9, further comprising:

each of said first, second and third sets of exterior loop members comprising three exterior loop members.

11. The tent assembly of claim 9, further comprising:

said tubular main portion having a substantially circular shaped cross section taken transverse to a longitudinal axis extending through a center of said tubular main portion; and said first and second sets of exterior loop members being coupled to an upper half of said tubular main portion.

12. The tent assembly of claim 9, further comprising:

said plurality of exterior loop members including a bottom set of loops coupled to a bottom of said tubular main portion to facilitate anchoring said tubular main portion to a ground surface.

13. The tent assembly of claim 1 further comprising:

a plurality of interior loop members coupled to an upper interior surface of said main member whereby said interior loop members are adapted for hanging items from said upper interior surface.

14. The tent assembly of claim 13 wherein each of said interior loop members is aligned with an associated one of said exterior loop members.

15. The tent assembly of claim 1 further comprising:

said main portion having a reinforced portion positioned opposite from said exterior loop members such that said reinforced portion forms a floor of said tent assembly when said support line members engage said exterior loop members to hold said main portion in said expanded position.

16. The tent assembly of claim 1, further comprising:

two pairs of outer tent support string members extending from said outer surface of said tubular main portion proximate said first end, each pair of outer tent support string members being positioned on a respective side of said main portion, each of said outer tent support string members being engageable to another of said outer tent support string members to form a pair of outer adjustment loops, a size of each said outer adjustment loop being adjustable by tying said outer tent support string members together at a desired position along lengths of each said pair of outer tent support string members.

17. The tent assembly of claim 1, further comprising:

said pair of tent support string members being a first pair of tent support string members and said adjustment loop being a first adjustment loop;

a second pair of tent support string members extending from said outer surface of said tubular main portion proximate said second end, each of said second pair of tent support string members being engageable to another of said second pair of tent support string members to form a second adjustment loop, a size of said second adjustment loop being adjustable by tying said second pair of tent support string members together at a desired position along lengths of said second pair of tent support string members;

said pairs of outer tent support string members being first end outer tent support string members and said outer adjustment loops being a first end adjustment loops;

two pairs of second end outer tent support string members extending from said outer surface of said tubular main portion proximate said second end, each of said second end outer tent support string members being engageable to another of said second end outer tent support string members to form a pair of second end adjustment loops, a size of each said second adjustment loop being adjustable by tying said second end outer tent support string members together at a desired position along lengths of said second end outer tent support string members.

18. The tent assembly of claim 1 further comprising:

said plurality of exterior loops including a bottom set of loops coupled to a bottom of said tubular main portion to facilitate anchoring said tubular main portion to a ground surface.

19. A tent assembly comprising:

a tubular main portion having a first open end and a second open end;

a plurality of exterior loop members coupled to an outer surface of said main portion;

a plurality of support line members, each of said support line members being coupled to at least one of said exterior loop members, each of said support line members having a free end whereby each of said support line members is adapted for coupling to an object such that said exterior loop members are held in a substantially static position relative to each other for holding said main portion in an expanded position;

a pair of drawstring line members, each of said drawstring line members being coupled to said main portion proximate an associated one of said first and second open ends for selectively closing said first and second open ends;

a screen assembly coupled to an interior of said main portion proximate said first open end, said screen assembly having a screen opening adjustable between an open position and a closed position for selectively screening said first open end, said screen assembly permitting environmental communication through said first open end when said screen assembly is in said closed position;

said screen assembly being a first screen assembly;

a second screen assembly coupled to said interior of said main portion proximate said second open end, said second screen assembly having a screen opening adjustable between an open position and a closed position for selectively screening said second open end, said second screen assembly permitting environmental communication through said second open end when said second screen assembly is in said closed position;

a first screen zipper coupled to said first screen assembly, said first screen zipper extending around a central portion of said first screen assembly whereby said central portion of said first screen assembly is selectively openable to permit movement through said first screen assembly;

said first screen zipper extending around a lower perimeter portion of said central portion of said first screen assembly to form a first flap;

a second screen zipper coupled to said second screen assembly, said second screen zipper extending around a central portion of said second screen assembly whereby said central portion of said second screen assembly is selectively operable to permit movement through said second screen assembly;

said second screen zipper extending around a lower perimeter portion of said central portion of said second screen assembly to form a second flap;

a pair of tent support string members extending from said outer surface of said tubular main portion proximate said first end, each of said tent support string members being engageable to another of said tent support string members to form an adjustment loop, a size of said adjustment loop being adjustable by tying said tent support string members together at a desired position along lengths of said pair of tent support string members;

said pair of tent support string members being a first pair of tent support string members and said adjustment loop being a first adjustment loop;

a second pair of tent support string members extending from said outer surface of said tubular main portion proximate said second end, each of said second pair of tent support string members being engageable to another of said second pair of tent support string members to form a second adjustment loop, a size of said second adjustment loop being adjustable by tying said second pair of tent support string members together at a desired position along lengths of said second pair of tent support string members;

said plurality of exterior loop members including a first, second and third set of exterior loop members;

said first set of exterior loop members being aligned along a first side of said tubular main portion;

said second set of exterior loop members being aligned along a second side of said tubular main portion;

said third set of exterior loop members being aligned along a top of said tubular main portion;

each of said first, second and third sets of exterior loop members comprising three exterior loop members;

said tubular main portion having a substantially circular shaped cross section taken transverse to a longitudinal axis extending through a center of said tubular main portion;

said first and second sets of exterior loop members being coupled to an upper half of said tubular main portion;

a plurality of interior loop members coupled to an upper interior surface of said main member whereby said interior loop members are adapted for hanging items from said upper interior surface;

wherein each of said interior loop members is aligned with an associated one of said exterior loop members;

said main portion having a reinforced portion positioned opposite from said exterior loop members such that said reinforced portion forms a floor of said tent assembly when said support line members engage said exterior loop members to hold said main portion in said expanded position;

two pairs of outer tent support string members extending from said outer surface of said tubular main portion proximate said first end, each pair of outer tent support string members being positioned on a respective side of said main portion, each of said outer tent support string members being engageable to another of said outer tent support string members to form a pair of outer adjustment loops, a size of each said outer adjustment loop being adjustable by tying said outer tent support string members together at a desired position along lengths of each said pair of outer tent support string members;

two pairs of second end outer tent support string members extending from said outer surface of said tubular main portion proximate said second end, each of said second end outer tent support string members being engageable to another of said second end outer tent support string members to form a pair of second end adjustment loops, a size of each said second adjustment loop being adjustable by tying said second end outer tent support string members together at a desired position along lengths of said second end outer tent support string members;

said screen assembly being positioned between said first open end of said main portion and said drawstring assembly coupled proximate said first open end; and said second screen assembly being positioned between said second open end of said main portion and said drawstring assembly coupled proximate said second open end.

20. A tent assembly comprising:

a tubular main portion having a first open end and a second open end;

a plurality of exterior loop members coupled to an outer surface of said main portion;

a plurality of support line members, each of said support line members being coupled to at least one of said loop members, each of said support line members having a free end whereby each of said support line members is adapted for coupling to an object such that said loop members are held in a substantially static position relative to each other for holding said main portion in an expanded position;

a pair of drawstring line members, each of said drawstring line members being coupled to said main portion proximate an associated one of said first and second open ends for selectively closing said first and second open ends; and a plurality of interior loop members coupled to an upper interior surface of said main member whereby said interior loop members are adapted for hanging items from said upper interior surface; and each of said interior loop members being aligned with an associated one of said exterior loop members.

* * * * *